United States Patent [19]

Bürki

[11] 3,968,642

[45] July 13, 1976

[54] WATCH-MOVEMENT FRAME WITH EXTRA HOLES FOR USING DIFFERENT ESCAPEMENT MECHANISMS

[75] Inventor: Hagues Bürki, L'Orient, Switzerland

[73] Assignee: Societe Suisse pour l'Industrie Horlogere Management Services S.A., Switzerland

[22] Filed: Jan. 21, 1975

[21] Appl. No.: 542,785

[30] Foreign Application Priority Data

Jan. 25, 1974 Switzerland ..... 1053/74

[52] U.S. Cl. ..... 58/59; 58/104; 58/121 R

[51] Int. Cl.² ..... G04B 33/00; G04B 29/02; G04B 15/08

[58] Field of Search ..... 58/59, 104, 116 R, 121 R

[56] References Cited

UNITED STATES PATENTS

| | | | |
|---|---|---|---|
| 2,872,775 | 2/1959 | Maire | 58/59 |
| 3,802,183 | 4/1974 | Erard | 58/59 |

*Primary Examiner*—George H. Miller, Jr.
*Attorney, Agent, or Firm*—Stevens, Davis, Miller & Mosher

[57] ABSTRACT

A watch movement frame having a plate with one set of holes aligned in one direction and a second set aligned in a second direction offset, for example 25°, from the alignment axis of the first set of holes. This results in a standardized plate permitting its use with a number of different escapement mechanisms which can seat in the different sets of holes.

9 Claims, 1 Drawing Figure

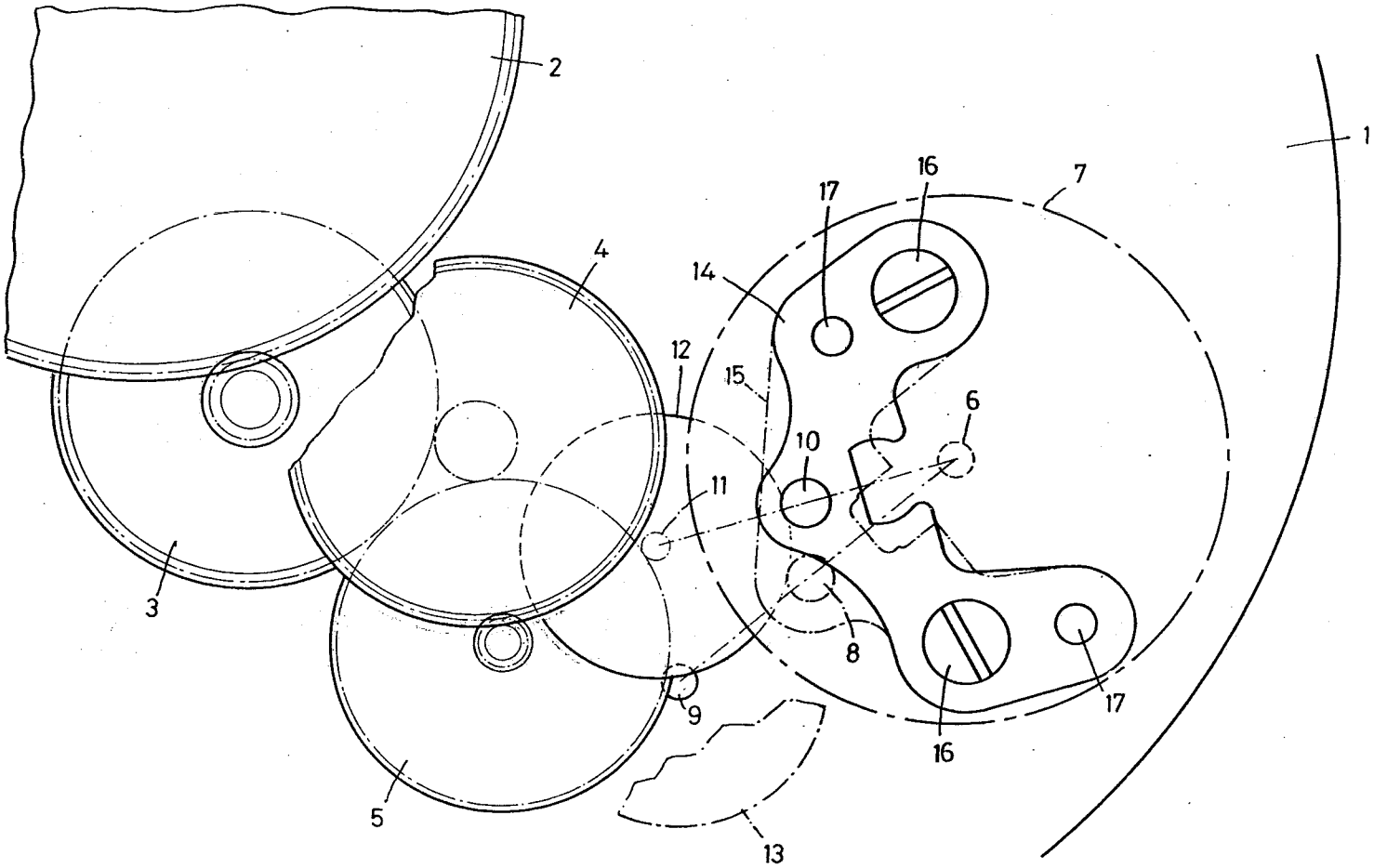
1
2
3
4
5
6
7
8
9
10
11
12
13
14
15
16
17
16
17

WATCH-MOVEMENT FRAME WITH EXTRA HOLES FOR USING DIFFERENT ESCAPEMENT MECHANISMS

This invention relates to a watch-movement frame comprising a plate having holes for receiving bearings situated at the locations of gears of a wheel-train, of a pallet-lever, and of a balance.

It is well-known fact that the quality of a watch movement depends not only upon the care with which it is manufactured, but also, and to a great extent, upon the design and construction of the escapement. The driving torque and the moment of inertia of the balance being equal, the smaller the centering of an escapement is, the better it will be. In a watch movement, the term "centering of the escapement" means the grouping of three points determined on the plate by the positions of the axes of the balance, of the pallet-lever, and of the escape-wheel. As a general rule, these three points are situated in a straight line. The centering dimensions indeed determine the size of the pallet-lever and that of the escape-wheel, and the inertia of those parts continuously constitutes a disturbing factor in the running of the movement. The quality of a movement may likewise be improved by increasing the frequency of the balance; and for some years now, designers of assortments have already been developing escapements with reduced centering having an escape-wheel with more than 15 teeth which is suitable for arrangements in which the oscillating system vibrates at a higher frequency than the usual 18,000 or 21,600 vibrations per hour.

On the other hand, in order to produce low cost-priced watch movements, it is above all important to choose simple arrangements which lend themselves to mass-production. Now certain parts, such as frame elements, for example, can currently be manufactured by high-precision automatic means which ensure not only very rapid production, and consequently a favorable cost-price, but also good quality owing to the high precision of the blanking machines available nowadays.

These rapid and efficient manufacturing methods may be applied to the production of frame elements which may be used equally well both in watch movements of medium or ordinary quality and in high-quality watch movements.

It is the object of this invention to increase the efficiency of manufacture of related calibers of differing quality so that rapid and efficient production methods may apply to the manufacture of high-quality calibers and may contribute towards reducing their cost-price.

To this end, in the watch-movement frame according to the present invention, two of the holes are aligned in a first direction with respect to the location of the balance and are situated at respective distances from its axis corresponding to the dimensions of a first standard escapement centering, and another two of the holes are aligned in a second direction with respect to the location of the balance and are situated at respective distances from its axis corresponding to the dimensions of a second standard escapement centering.

A preferred embodiment of the invention will now be described in detail with reference to the accompanying drawing, the sole FIGURE of which is a plan view of part of a watch movement, the frame of which constitutes the aforementioned embodiment.

The diagrammatical drawing represents the wheel-train of a round watch movement, the main frame element of which is a plate 1. Shown in diagram are a barrel 2, an intermediate wheel-and-pinion 3, a third wheel-and-pinion 4, and a fourth wheel-and-pinion 5 disposed off-center, e.g., at 9 o'clock. The other elements of the movement, particularly the winding and setting mechanism, are not shown. It shall be assumed, however, that the winding-stem extends vertically at the upper part of the drawing. The plate 1 is a stamped and blanked part having recesses intended to receive certain of the wheels and pinions or other members of the movement. The plate 1 is formed in one operation or in a series of successive operations of blanking and stamping with all the holes necessary for receiving the bearings of the various wheels and pinions, as well as those provided for the securing and positioning of the bridges. After the blanking operation, the plate undergoes various other machining operations: milling of the recesses, tapping of the holes for securing the bridges, etc. Last comes the operation consisting in fitting the bearings. The holes provided for the bearings are generally round ones of about 0.8–0.9 mm. in diameter.

The plate 1 has a hole 6 intended to receive the shock-absorber body which will support the lower end of a balance-staff 7. The balance-staff 7, shown in dot-dash outline is located above the pallet cock, in accord with standard mechanical watch movement construction. It also has four other holes, the characteristics and arrangement of which are important. Two holes 8 and 9 are aligned with the hole 6, at respective distances corresponding to the dimensions of the standard escapement centering specified, for example, in Allgemeine Schweizerische Uhrenindustrie A.G. (ASUAG) Standard No. 8 (distance 6–8 = 3.4 mm. and 8–9 = 3.05 mm), while two other holes 10 and 11 are likewise aligned with the hole 6 in a direction forming an angle of about 25° with that of the alignment 8,9. The distances between the holes 10 and 11 and the hole 6 correspond to the dimensions of a standard escapement smaller than the ASUAG Standard No. 8 escapement (e.g., Standard No. 203: distance 6–10 = 2.83 mm. and 10–11 = 2.83 mm.). To be exact, these dimensions correspond to a centering for which two different versions are to be found in the series of ASUAG standard escapements; one of these versions is intended for a frequency of 21,600 vibrations per hour with a 15-tooth escape-wheel (No. 153), the other for a frequency of 28,800 vibrations per hour with a 20-tooth escape-wheel (No. 203).

The directions of the two alignments described are such that the holes 9 and 11 are equidistant from the axis of the fourth wheel.

It will be readily understood that this arrangement makes it possible to mount any one of several standard escapements on the movement frame described. If escapements are used whose centering corresponds to the dimensions of the alignment 10, 11, the escape-wheel will be placed in the bearing fitted in the hole 11 and the pallet-lever in the bearing fitted in the hole 10, with the escape-wheel occupying the position shown as 12 in the drawing, for example, while in the other case, the escape-wheel will occupy the position shown as 13. It will be noted that the pinion of the escape-wheel may be the same size in both cases and that it will mesh satisfactorily with the fourth wheel 5.

The upper bearing of the escape-wheel will be secured in the wheel-train bridge, which will comprise the two holes necessary for driving in either a pivot-bearing 9 or a pivot-bearing 11. Two different designs, 14 and 15, will be provided for the pallet-cock, which will, for example, be secured by means of two screws 16 engaged in threaded holes in the plate 1 and positioned by means of feet 17. The means for securing the pallet-cock are at the same location for all the variations in use of the plate 1 described above.

This plate presents the advantage of being usable just as it is in four different but related calibers which consequently comprise the same barrel and the same wheel-train. It is indeed a matter of general knowledge that there are two standardized types of escapement having the same centering as the ASUAG No. 8 escapement. These two types of escapement make it possible to attain frequencies of 21,600 vibrations per hour, and they each comprise a 15-tooth escape-wheel. One of them is made of metal, whereas the other is made of synthetic material and has a low cost-price.

Moreover, among the standardized escapements having smaller centering than that of ASUAG No. 8, there are likewise two standard escapements with the same centering. One of them is an escapement having a 20-tooth escape-wheel to give a frequency of 28,800 vibrations per hour, and the other is an escapement with a 15-tooth escape-wheel to give a frequency of 21,600 vibrations per hour with the same escape-wheel pinion.

Thus the plate may be used in four calibers having the escapement characteristics shown in the following table:

| | Line | Frequencies (vib./hour) | Escape-Wheel | | Material | Quality - Performance | Price |
|---|---|---|---|---|---|---|---|
| 1 | 11-10-6 | 28,800 | 20 | teeth | metal | excellent | high |
| 2 | 11-10-6 | 21,600 | 15 | " | " | good | medium |
| 3 | 9-8-6 | 21,600 | 15 | " | " | medium | " |
| 4 | 9-8-6 | 21,600 | 15 | " | synthetic | ordinary | low |

Thus the arrangement described makes it possible to increase the efficiency of manufacturing timepiece movements of different levels of quality.

It may be mentioned in conclusion that in another possible embodiment, the fourth wheel 5 might also be situated in the center of the plate 1. This shift could be accomplished without making any changes in the barrel 2, the intermediate wheel 3, or the third wheel 4. The location of the balance could then be slightly modified, and the two alternate positions provided for the escape-wheel and for the pallet-lever would naturally be situated elsewhere. In this other embodiment, too, four different calibers could be formed with the same plate, a pallet-cock secured at the same location, the same wheel-train, and the same wheel-train bridge.

What is claimed is:

1. A watch-movement frame comprising a plate having holes for receiving bearings situated at the locations of gears of a wheel-train, of a pallet-lever, and of a balance, wherein two said holes are aligned in a first direction with respect to the location of said balance and are situated at respective distances from the axis of said balance corresponding to the dimensions of a first standard escapement centering, and another two said holes are aligned in a second direction with respect to the location of said balance and are situated at respective distances from the axis of said balance corresponding to the dimensions of a second standard escapement centering.

2. A frame in accordance with claim 1, wherein the said holes of one of said alignments are provided with said bearings, and the said holes of the other of said alignments are empty.

3. A frame in accordance with claim 1, wherein said plate comprises one series of said holes for securing and positioning a pallet-cock.

4. A frame in accordance with claim 3, wherein said pallet-cock comprises one hole for receiving a bearing.

5. A frame in accordance with claim 1, wherein the said holes of one of said alignments are arranged to correspond to the dimensions of the centering of Standard No. 8 of the Allgemeine Schweizerische Uhrenindustrie A.G., and the said holes of the other of said alignments are arranged to correspond to the dimensions of a smaller standard centering.

6. A frame in accordance with claim 5, wherein the said holes of said other of said alignments are arranged to correspond to the dimensions of a standard centering of an escapement having a 20-tooth escape-wheel and enabling a frequency of 28,800 vibrations per hour or more to be attained.

7. A frame in accordance with claim 1, wherein the two said holes of said alignments which are farthest from the location of said balance are equidistant from the location of a fourth wheel of said wheel-train.

8. A frame in accordance with claim 7, wherein the location of said fourth wheel is situated in the center of said plate.

9. A frame in accordance with claim 7, wherein the location of said fourth wheel is off-center.

* * * * *